US006824033B2

(12) United States Patent
Chon

(10) Patent No.: US 6,824,033 B2
(45) Date of Patent: Nov. 30, 2004

(54) TAPE FEEDER

(75) Inventor: Chong Pil Chon, Kyungki-do (KR)

(73) Assignee: Mirae Corporation, Choongchungnam-do (KR)

( * ) Notice: Subject to any disclaimer, the term of this patent is extended or adjusted under 35 U.S.C. 154(b) by 0 days.

(21) Appl. No.: 10/336,742

(22) Filed: Jan. 6, 2003

(65) Prior Publication Data

US 2004/0040998 A1 Mar. 4, 2004

(30) Foreign Application Priority Data

Aug. 28, 2002 (KR) ..... 10-2002-0051244

(51) Int. Cl.[7] ..... B65H 20/00

(52) U.S. Cl. ..... 226/128; 226/129; 242/615.3; 242/564.4; 156/584

(58) Field of Search ..... 226/128, 129; 156/584; 242/615.3, 564.4

(56) References Cited

U.S. PATENT DOCUMENTS 6,032,845 A 3/2000 Piccone et al. ..... 226/139

*Primary Examiner*—Kathy Matecki
*Assistant Examiner*—Evan Langdon
(74) *Attorney, Agent, or Firm*—Fleshner & Kim, LLP

(57) ABSTRACT

The present invention discloses a tape feeder for supplying plural electronic components arranged and mounted to a tape in turn comprising: a main frame; a shutter installed to an upper portion of the main frame for opening and closing a component discharge opening of the electronic components; first and second sprocket wheels installed to a lower portion of the shutter for moving the tape received the electronic components by a predetermined pitch; a rotating latch connected to the first and second sprocket wheels for rotating the first and second sprocket wheels; plural levers connected to a side of the rotating latch for driving the rotating latch; an eccentric cam having a taper formed at its side constructed rotatably for driving the rotating lever; a shutter lever constructed for performing the forward and backward movement of the shutter by the driving of the eccentric cam; and a manual lever for moving the tape by one pitch by a worker when an initial work is set to supply the electronic components.

18 Claims, 6 Drawing Sheets

TAPE FEEDER

BACKGROUND OF THE INVENTION

1. Field of the Invention

The present invention relates to a tape feeder, more particularly, to a tape feeder in which an impact caused by a pitch transfer of a tape is removed, electronic components do not protruded, the exact opening and closing of a shutter is performed. Simultaneously, in the tape feeder of the present invention, it is possible to move manually when installing the tape feeder.

2. Description of the Background Art

Conventionally, an electronic component mount device sucks and picks up electronic components installed to a part feeder by vacuum to a nozzle of a transfer head, transfers and mounts the electronic components to a printed circuit board. There are many kinds of part feeder such as a tape feeder, a tube feeder and a tray feeder etc. Among these, especially, the tape feeder has been widely used because it is easy to supply the electronic components in large quantities.

Conventionally, as shown in FIG. 1, the tape feeder comprises a main frame 10, a cover plate 20 installed to an upper portion of the main frame 10, a shutter plate 30 installed to an upper portion of the main frame 10, a pitch transfer unit 40 installed to a lower portion of the cover plate 20 and a pitch transfer means 50 connected to the pitch transfer unit 40 for driving the pitch transfer unit 40.

The cover plate 20 is installed to a front side of the main frame 10, the shutter plate 30 is reached in good condition to an upper portion of the cover plate 20 and a push member 31 is formed at a front lower portion of the cover plate 20.

The cover plate 20 can be slide with a state that the push member 31 is inserted to a slide groove 21 formed on its side. A cover tape exfoliation unit 22 is formed at a rear side of the push member 31 and the push member 31 pushes the electronic components, so that the separation of the electronic components can be prevented.

Also, a guide groove 32, an oblong hole type, is formed at a side of the shutter plate 30, plural guide pins 34 are installed movably to the inside of the guide groove 32 and an incision groove 36 for receiving a pitch transfer member 52 is formed at a side of the guide groove 32.

The pitch transfer unit 40 comprises a first sprocket wheel 40*a* for performing a pitch transfer of an enclosure tape (not shown), a second sprocket wheel 40*b* installed to a side of the first sprocket wheel 40*a* for rotating together with the first sprocket wheel 40*a*, a latch 42 installed to a side of the second sprocket wheel 40*b* for preventing from rotating reversely the second sprocket wheel 40*b*, a first lever 43 in which its end is connected fixedly to a center of the first and second sprocket wheels 40*a* and 40*b* for performing a pitch transfer of the first and second sprocket wheels 40*a* and 40*b*, a rotation shaft 44 installed rotatably to the other side of the first lever 43, a second lever 46 connected and installed together with the first lever 43 by the rotation of the shaft 44, a third lever 47 positioned on the same straight line of the second lever 46, an elastic member 48 for connecting together the secong and third levers 46 and 47, and an eccentric cam 49 installed at a side of the third lever 47.

A pin 49*a* is formed at an eccentric portion which is apart from the center of the eccentric cam 49 and an end of the third lever 47 is installed to the pin 49*a*, so that the third lever 47 is driven by the rotation of the cam 49.

Also, the pitch transfer means 50 being driven together with the pitch transfer unit 40 comprises a transfer lever 51 in which its end is connected to the rotation shaft 44, and a pitch transfer member 52 connected to a side of the transfer lever 51.

As described above, in the conventional tape feeder, when the eccentric cam 49 is rotated by a driving source (not shown), the third lever 47 connected to the pin 49*a* formed at a side of the eccentric cam 49 performs a straight-line motion.

The second lever 46 positioned on the same straight line of the third lever 47 performs elastically a straight-line motion by the elastic member 48 connected to a side of the third lever 47 and a side of the second lever 46.

When the pin 49*a* formed at a side of the eccentric cam 49 takes a half-turn, the eccentric cam 49 pulls the third lever 47, whereas when the eccentric cam 49 takes a turn, the pin 49*a* is returned at its original position, the eccentric cam 49 pushes the third lever 47.

The first lever 43 is pulled by the movement of the second lever 46 and at this time, the first sprocket wheel 40*a* is rotated by the first lever 43 by one pitch.

Also, the second sprocket wheel 40*b* combined together with the first sprocket wheel 40*a* is rotated by one pitch, the second sprocket wheel 40*b* does not rotate reversely by the latch 42, when the second sprocket wheel 40*b* is rotated regularly, the latch 42 slides against its outer surface.

On the other hand, when the second lever 46 is pulled by the third lever 47, the transfer lever 51 combined together with the second lever 46 to the rotation shaft 44 is also pulled and performs a straight-line movement.

By the transfer of the transfer lever 51, the pitch transfer member 52 pushes a side of the incision groove 36, so that the shutter plate 30 is transferred by one pitch.

When the eccentric cam 49 takes a turn completely, the first lever 43, the second lever 46 and the third lever 47 are returned to the original position by the pin 49*a*, since the first sprocket wheel 40*a* and the second sprocket wheel 40*b* are rotated with one direction by the first lever 43 and do not rotated reversely by the latch 42, so that the enclosure tape advances by one pitch.

As described above, there are several disadvantages that since in the conventional tape feeder, the transfer lever 51 and the pitch transfer member 52 are formed integrally, in the setting process of the enclosure tape received electronic components for supplying the electronic components, the enclosure tape can not be driven separately, so that a working position of the enclosure tape and the electronic components can not be maintained closely.

SUMMARY OF THE INVENTION

Accordingly, it is a primary object of the present invention to provide a tape feeder in which the first and second sprocket wheels and shutter can be driven separately by using an eccentric cam.

Another object of the present invention is to provide a tape feeder in which its entire construction is simple and it can be initiated by a simple operation of the manual lever when mounting the tape feeder.

In one aspect of the present invention, to achieve the above-described objects of the invention, there is provided a tape feeder for supplying plural electronic components arranged and mounted to a tape in turn comprising: a main frame; a shutter installed to an upper portion of the main frame for opening and closing a component discharge opening of the electronic components; first and second sprocket wheels installed to a lower portion of the shutter for moving the tape received the electronic components by a predetermined pitch; a rotating latch connected to the first and second sprocket wheels for rotating the first and second sprocket wheels; plural levers connected to a side of the rotating latch for driving the rotating latch; an eccentric cam having a taper formed at its side constructed rotatably for driving the rotating latch; a shutter lever constructed for performing the forward and backward movement of the shutter by the driving of the eccentric cam; and a manual lever for moving the tape by one pitch by a worker when an initial work is set to supply the electronic components.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

A tape feeder in accordance with preferred embodiments of the present invention will now be described in detail with reference to the accompanying drawings.

Figure 1:
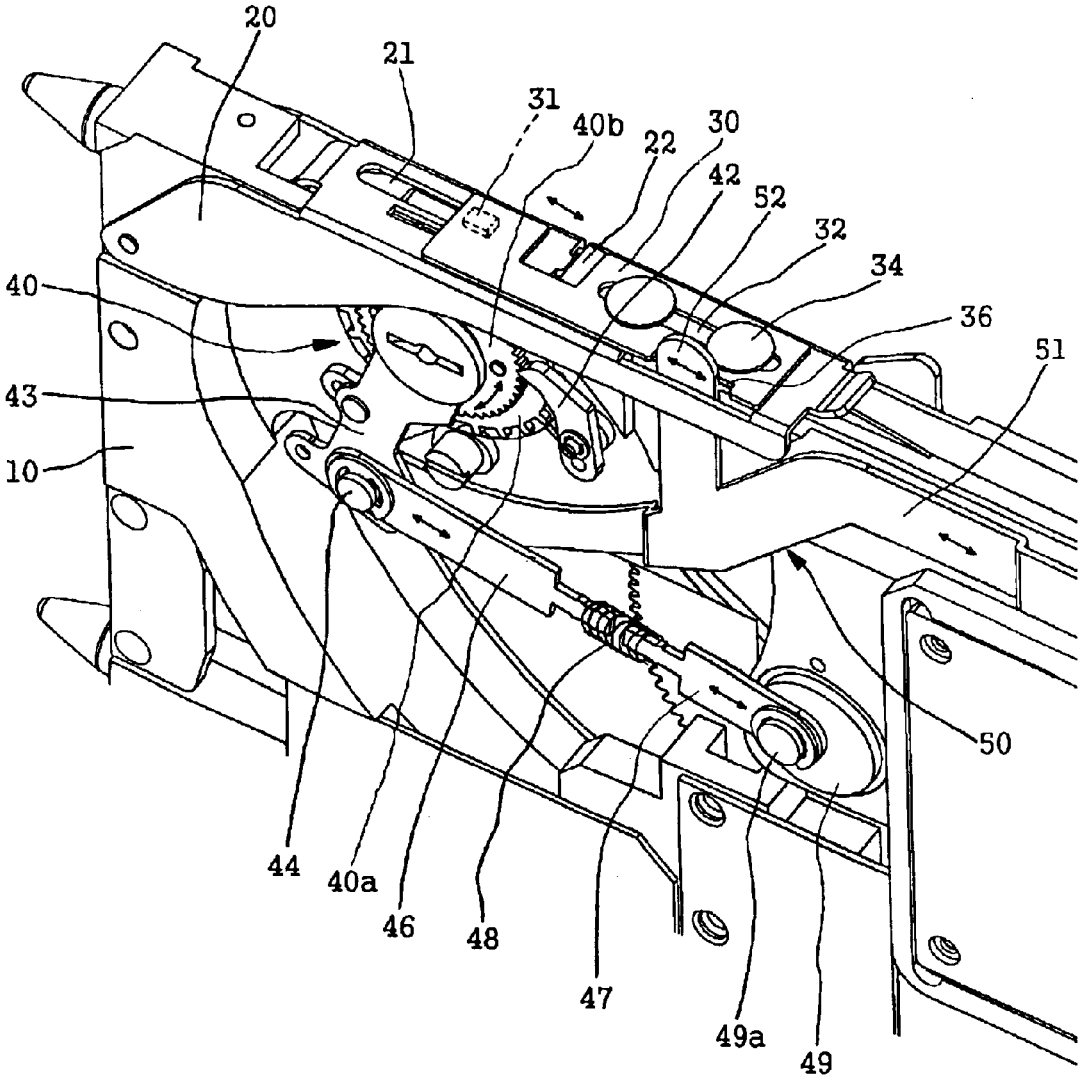
FIG. 1 Prior Art
FIG. 1 is a perspective view illustrating a tape feeder according to a conventional art.
Figure 2:
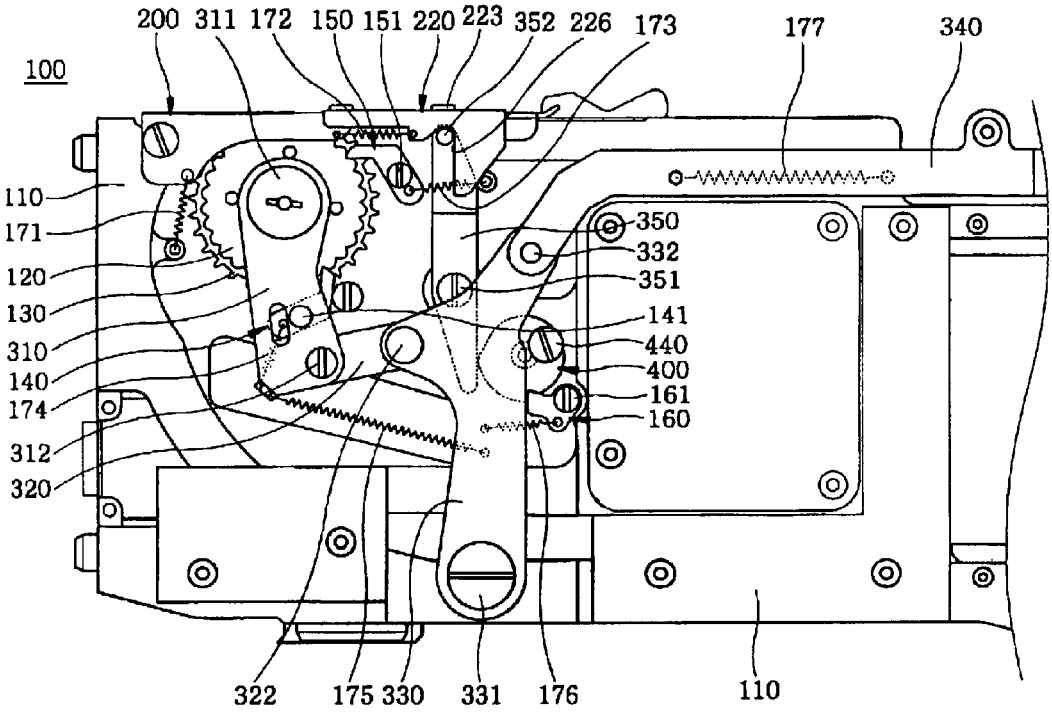
FIG. 2 is a side view illustrating a tape feeder applied to the present invention.
Figure 3:
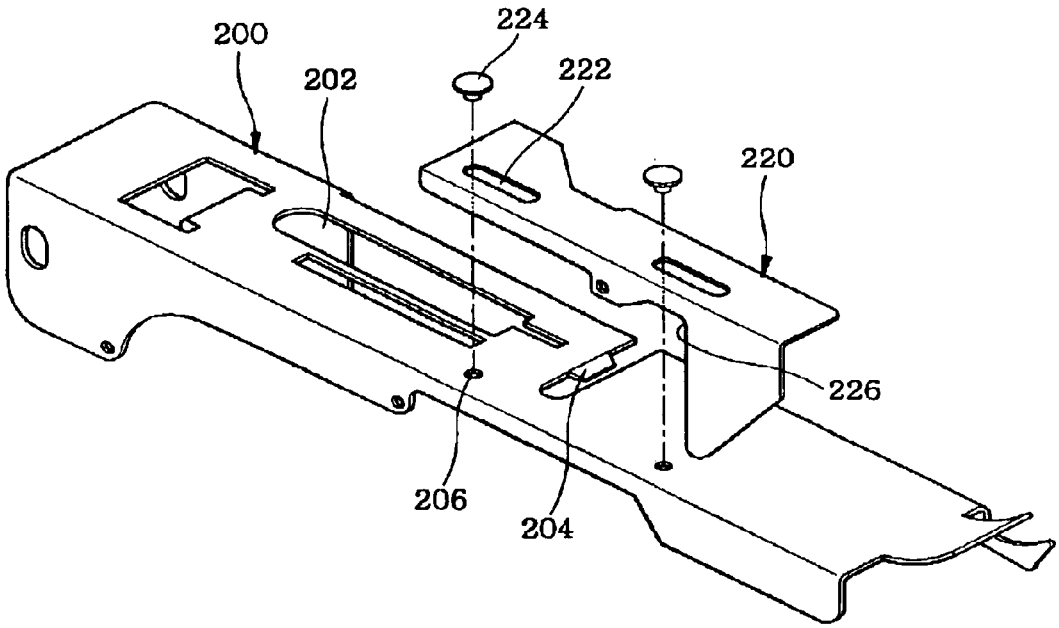
FIG. 3 is a perspective view illustrating a shutter installed to a cover plate.
Figure 4:
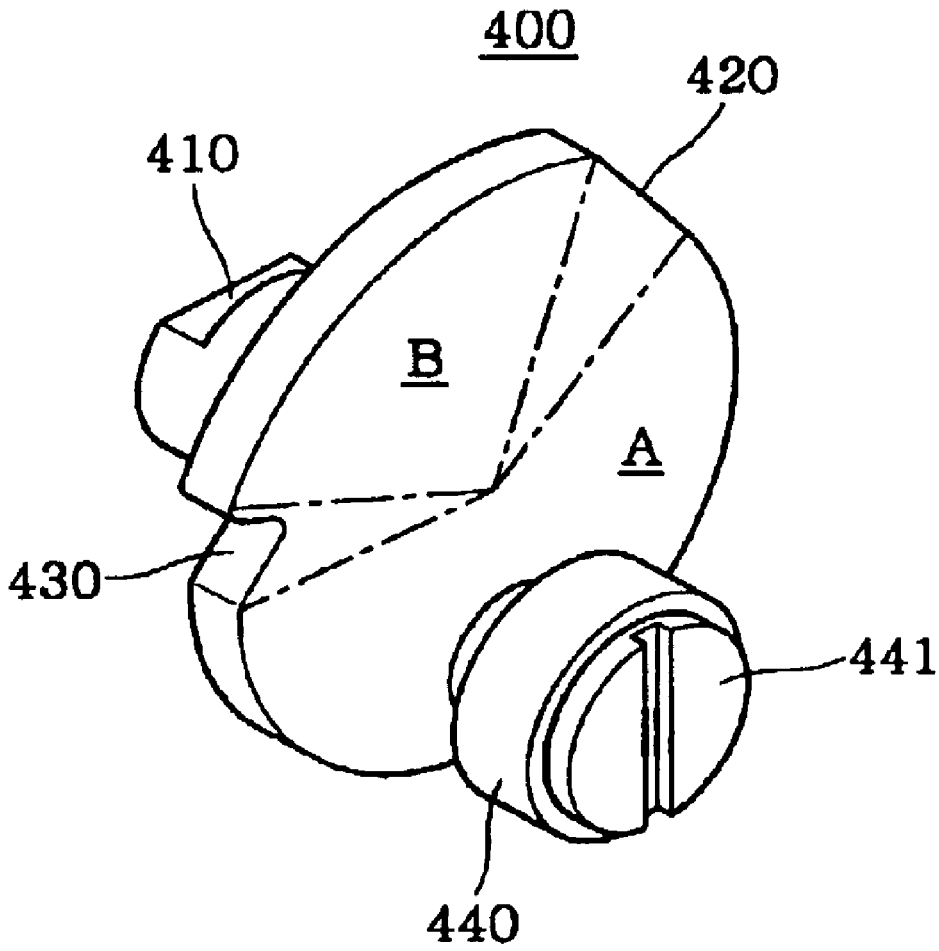
FIG. 4 is a perspective view illustrating an eccentric cam applied to a tape feeder.
Figure 5A:
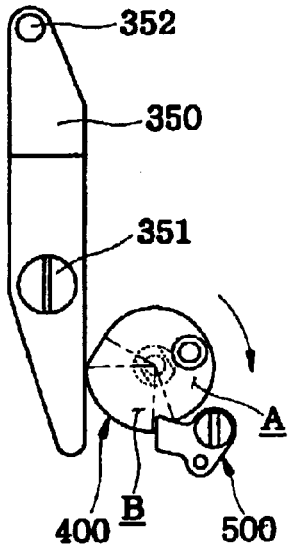
FIGS. 5*a* to 5*c* are side views illustrating operation flows of an eccentric cam.
Figure 5B:
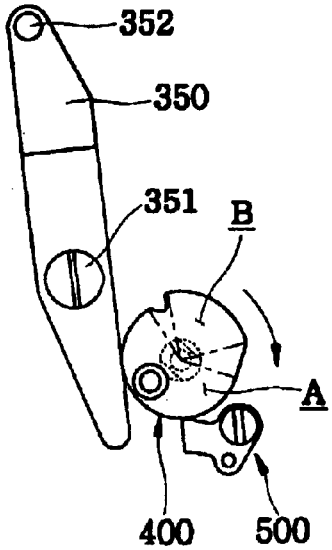
Figure 5C:
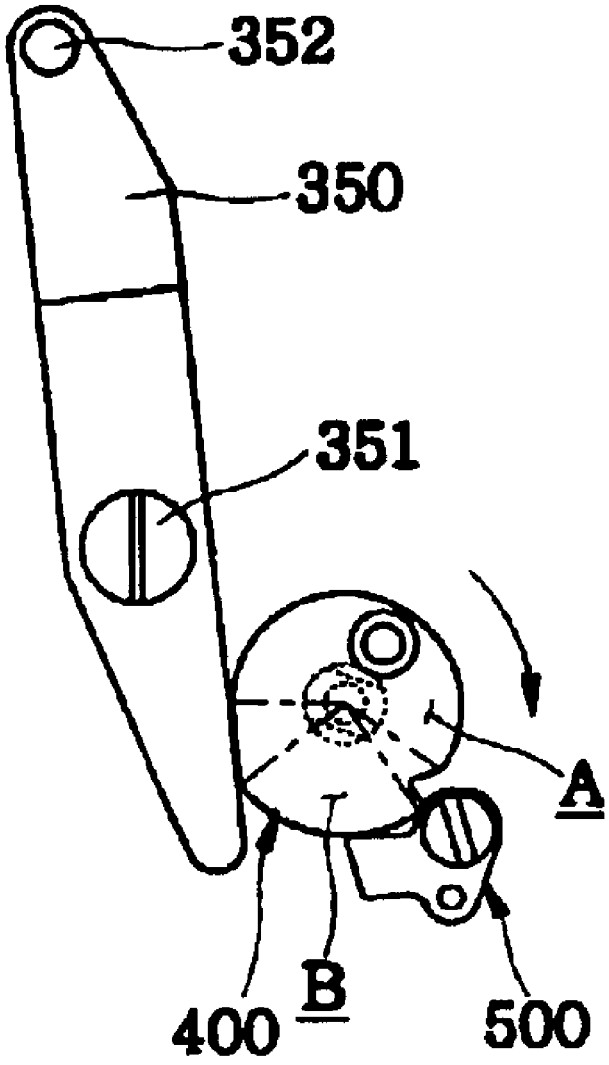

FIG. 2 is a side view illustrating a tape feeder applied to the present invention. FIG. 3 is a perspective view illustrating a shutter installed to a cover plate. FIG. 4 is a perspective view illustrating an eccentric cam applied to a tape feeder. FIGS. 5*a* to 5*c* are side views illustrating operating flows of the eccentric cam.

The tape feeder 100 according to the present invention, as shown in FIG. 2, comprises a main frame 110, a cover plate 200 installed to an upper portion of the main frame 110, a shutter 220 installed to an upper portion of the cover plate 200, first and second sprocket wheels 120 and 130 installed to a lower portion of the cover plate 200, plural levers 310, 320, 330, 340 and 350 installed to a side of the first and second sprocket wheels 120 and 130 for driving the first and second sprocket wheels 120 and 130, and a cam 400 for driving the rotation lever 330 among the plural levers 310, 320, 330, 340 and 350.

The cover plate 200 is installed to an upper front portion of the main frame 110 and a first elastic member 171 is installed to a side of the cover plate 200, so that the cover plate 200 is supported elastically against the main frame 110.

On the other hand, in the cover plate 200, as shown in FIG. 3, a component discharge opening 202 is formed at an upper front portion of the cover plate 200 for picking the electronic components, a vinyl exfoliation unit 204, which can exfoliate the vinyl (not shown) attached to an upper portion of the enclosure tape for protecting the electronic components, is formed at a side of the component discharge opening 202, and plural holes 206 are formed at a side of the vinyl exfoliation unit 204.

Also, plural oblong type holes 222 are formed at an upper side portion of the cover plate 200 and plural guide pins 224 are inserted to the oblong type holes 222 and combined to the plural holes 206 of the cover plate 200, so that the shutter 220 is installed to an upper portion of the cover plate 200.

The shutter 220, combined as above, is guided and can be moved forwardly and backwardly by the guide pin 224 as well as the length of the oblong type hole 222 toward the longitudinal direction of the cover plate 200. A hooking jaw 226 is formed at a side of the shutter 220.

On the other hand, in the first and second sprocket wheels 120 and 130 installed to a lower portion of the cover plate 200, as shown in FIG. 2, a center portion of the first and second sprocket wheels 120 and 130 and an end of a sprocket wheel lever 310 are combined and the sprocket wheels 120 and 130 are installed to the main frame 110 by the sprocket wheel shaft 311, so that the first and second sprocket wheels 120 and 130 can be supported to the sprocket wheel shaft 311 and can be rotated.

Also, a rotation latch 140 is fixed firmly and combined to a side of the sprocket wheel lever 310 by a combining pin 141. When the sprocket wheel lever 310 rotates forwardly and backwardly at the center of the sprocket wheel shaft 311 with a constant section, the rotation latch 140 also moves forwardly and backwardly together, so that the first sprocket wheel 120 can be rotated toward the regular direction.

At a side of the rotation latch 140, a fourth elastic member 174 is installed to a side of the sprocket wheel lever 310 and so the rotation latch 140 is contacted closely and elastically against the first sprocket wheel 120. When the sprocket wheel lever 310 rotates forwardly, the rotation latch 140 is slide against the first sprocket wheel 120 by an elastic force of the fourth elastic member 174. When the sprocket wheel lever 310 rotates backwardly, the first sprocket wheel 120 is moved through the rotation latch 140 by one pitch.

By the operation, as mentioned above, when the first sprocket wheel 120 rotates by one pitch, the second sprocket wheel 130, which is firmly combined with the first sprocket wheel 120, rotates together with the first sprocket wheel, so that the enclosure tape received electronic components can be moved forwardly by one pitch.

Also, at a side of the first sprocket wheel 120, a stopper 150 installed to the main frame 110 rotatably by a stopper shaft 151 is supported elastically by the third elastic member 173 installed to its side and can prevent the reverse-rotation of the first sprocket wheel 120.

On the other hand, the sprocket wheel lever 310 is connected to a support lever 320 by a first connection pin 312, which is installed at its side. The other end of the support lever 320 is connected to a side of the rotation lever 330 by a second connection pin 322, and a manual lever 340 is connected to the other end of the rotation lever 330 by the third connection pin 332. The manual lever 340 is supported elastically by a seventh elastic member 177, which is connected to its side and a side of the main frame 110.

Also, a fifth elastic member 175 is installed to a side of the rotation lever 330 and a side of the sprocket wheel lever 310, so that the rotation lever 330 and the sprocket wheel lever 310 can be supported elastically with each other.

Since the respective levers 310, 320, 330, 340 and 350 are connected rotatably to the respective connection pins 312, 322 and 332, the driving force generated by the driving source can be transferred organically, the manual lever 340 can start a work for supporting electronic components by the manual operation of a worker when performing an initial working.

On the other hand, since a side of the rotation lever 330 among the levers 310, 320, 330, 340 and 350 is installed to the main frame 110 by the rotation lever shaft 331, it can be supported to the rotation lever shaft 331 and can be rotated.

An eccentric cam 400 capable of rotating 360 degree is installed to a side of the rotation lever 330 and a cam latch 160 is installed rotatably to a side of the rotation lever 330 by a cam latch shaft 161. Also, the cam latch shaft 161 of the cam latch 160 is installed sildably to an oblong type hole (not shown), so that it can cope with an unreasonable rotation of the eccentric cam 400.

A sixth elastic member 176 is installed to a side of the cam latch 160, and the cam latch 160 is contacted closely and elastically to an outer surface of the eccentric cam 400. When the eccentric cam 400 is rotated regularly, the cam latch 160 is slide, when the eccentric cam 400 is rotated reversely, the cam latch 160 is inserted and hooked to the groove 430 formed at its outer surface, so that the reverse rotation of the eccentric cam 400 is prevented.

On the other hand, the eccentric cam 400, as shown in FIG. 4, comprises a cam shaft 410 capable of being installed to the driving source, which is installed to the main frame 110, a taper 420 formed to an outer surface of the eccentric cam 400 with a predetermined angle, a groove 430 formed at the other side of the taper 420, and a roller 440 installed to a side surface of the eccentric cam 400 rotatably by a roller shaft 441.

Also, in the eccentric cam 400, there are four sections with a circular arc outwardly from the cam shaft 410, a diameter of the circular arc of A part is larger than that of the circular arc of B part, a taper 420 is formed between the circular arcs of A and B parts, and a groove 430 is formed between the circular arcs of A and B parts of the other side of the taper 420.

As shown in FIG. 2, the eccentric cam 400 rotates clockwise by the driving source, pushes a side of the rotation lever 330 by the roller 440, which is installed to its side, and can make the rotation lever 330 drive.

At this time, a shutter lever 350 is installed rotatably between the eccentric cam 400 and the shutter 220 by a shutter lever shaft 351. Also, since a shutter lever pin 352 is formed at a side of the shutter lever 350, when the shutter lever 350 is rotated with a predetermined angle, the shutter lever pin 352 pushes the hooking jaw 226 of the shutter 220 and the shutter 220 can be moved with a predetermined interval backwardly.

Also, after the shutter 220 is moved backwardly by the shutter lever pin 352 of the shutter lever 350, the shutter 220 is moved forwardly by an elastic force of the second elastic member 172 and can be positioned at its original position.

Also, another function according to the operation of the eccentric cam 400 will be described with reference to FIGS. 5*a* to 5*c*.

Firstly, an initial preparation state of the shutter lever 350 and the eccentric cam 400 is illustrated, as shown in FIG. 5*a*, at this time, the shutter 220 is closed.

As shown in FIG. 5*b*, in the shutter lever 350 and the eccentric cam 400, the eccentric cam 400 rotating toward an arrow mark's direction and the shutter lever 350 guided to its outer surface are illustrated and at this time, the shutter 220 is also closed.

As shown in FIG. 5*c*, in the shutter lever 350 and the eccentric cam 400, the shutter 220 is opened by the eccentric cam 400 rotating toward an arrow mark's direction and the shutter lever 350 guided against its outer surface.

Hereinafter, an operation of the tape feeder according to the present invention will be described.

Firstly, the eccentric cam 400 is rotated by the driving source and therefore the roller 440 pushes the rotation lever 330 toward the front side of the tape feeder 100 and the support lever 320 connected to the rotation lever 330 is pushed and therefore the sprocket wheel lever 310 connected to a side of the support lever 320 is rotated regularly.

At this time, the rotation latch 140 installed to a side of the sprocket wheel lever 310 is moved forwardly and thereafter the first sprocket wheel 120 is moved by the rotation latch 140 by one pitch through the reverse-rotation of the sprocket wheel lever 310, the second sprocket wheel 130 combined with the first sprocket wheel 120 is rotated, so the enclosure tape is moved by one pitch.

On the other hand, in the shutter lever 350 being driven by the rotating eccentric cam 400, the shutter lever pin 352 formed at a side of the shutter lever 350 pushes the hooking jaw 226 of the shutter 220 and thereby the shutter 220 is moved backwardly and the electronic components can be supplied and at this time, the electronic components are picked up by a picker (not shown).

An operation of the eccentric cam 400 will be described with reference to the accompanying drawings FIGS. 5*a* to 5*c*.

In order to push the rotation lever 330 through the roller 440 by the rotation of the eccentric cam 400, the eccentric cam 400 is rotated. Also, in order to correspond rapidly to the shutter lever 350, the eccentric cam 400 is rotated rapidly by the taper 420 of the eccentric cam 400 and the B part of the circular arc pushes the shutter lever 350. At this time, the shutter 220 is closed.

Also, when the roller 440 pushes the rotation lever 330 by the rotation of the eccentric cam 400, the shutter lever 350 is guided to an outer surface of the A part of the circular arc in which the roller 440 is installed. At this time, the shutter 220 is also closed.

Also, when the taper 420 of the eccentric cam 400 is coincided with a side of the shutter lever 350 by the continuing rotation of the eccentric cam 400, the shutter 220 is opened.

Also, when a setting work is performed in order to supply electronic components, the worker operates the manual lever 340 and therefore the enclosure tape is moved by one pitch and thereby the device can be set in order to be maintained closely to a working position capable of picking up the electronic components.

As described above, the first and second sprocket wheels and the shutter can be operated simultaneously and respectively by one rotation operation of the eccentric cam of the present invention as above-constructed, the above operations are performed continually and therefore the plural electronic components received to the enclosure tape can be supplied continually.

In the tape feeder of the present invention, there are several advantages that its connection construction is simple by using the eccentric cam capable of driving the first and second sprocket wheels and the shutter simultaneously and respectively, and the manual lever and simultaneously it can be initiated easily.

Also, there is also an advantage that the forward and backward movement can be implemented, that is, the reel supply is finished from the driving source rotation rotating toward one direction and thereafter the shutter is opened.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalences of such metes and bounds are therefore intended to be embraced by the appended claims.

What is claimed is:

1. A tape feeder for supplying plural electronic components arranged and mounted to a tape in turn comprising:

a main frame;

a shutter installed to an upper portion of the main frame for opening and closing a component discharge opening;

first and second sprocket wheels installed on the main frame and configured to move a tape holding electronic components by a predetermined pitch;

a rotating latch mounted on the main frame and configured to rotate the first and second sprocket wheels;

plural levers connected to a side of the rotating latch for driving the rotating latch;

an eccentric cam having a taper formed at its side and configured to drive the rotating latch via the plural levers;

a shutter lever coupled to the shutter and the eccentric cam and configured to move the shutter by the driving of the eccentric cam; and a manual lever coupled to the rotating latch and configured to move the rotating latch, but not the shutter lever.

2. A tape feeder according to claim 1, wherein the plural levers comprise a sprocket wheel lever, a support lever connected to the sprocket wheel lever by a first connection pin, and a rotating lever connected to the support lever by a second connection pin.

3. A tape feeder according to claim 1, wherein the eccentric cam has a groove formed at its outer surface.

4. A tape feeder according to claim 1, wherein a roller is installed to a side of the eccentric cam, and wherein the roller is configured to bear against one of the plural levers.

5. A tape feeder according to claim 1, further comprising a cam latch installed to a side of the eccentric cam and configured to prevent the reverse rotation of the eccentric cam.

6. A tape feeder according to claim 1, wherein the shutter lever is not coupled to the manual lever.

7. A tape feeder according to claim 1, wherein the manual lever is adapted to be operated independently of the shutter lever.

8. A tape feeder according to claim 1, wherein the first and second sprocket wheels can be rotated without operation of the shutter.

9. A tape feeder according to claim 1, wherein a first surface of the eccentric cam contacts the shutter lever, and a second surface of the eccentric cam contacts one of the plural levers.

10. A tape feeder according to claim 9, wherein the first surface comprises a periphery of the eccentric cam, and the second surface comprises a projection disposed on a side of the eccentric cam.

11. A tape feeder, comprising a main frame having a component discharge opening;

a shutter mounted on the main frame and configured to move to cover and expose the component discharge opening, a tape transfer unit configured to move a component supply tape relative to the component discharge opening;

a tape positioning member configured to operate the tape transfer unit, wherein the tape positioning member can cause the tape transfer unit to move the component supply tape without moving the shutter; and a cam configured to simultaneously operate the shutter and the tape transfer unit.

12. The part feeder of claim 11, wherein the cam comprises first and second surfaces, wherein the first surface drives the shutter and wherein the second surface drives the tape transfer unit.

13. The tape feeder of claim 12, wherein the first surface of the cam acts against a shutter level coupled to the shutter.

14. The part feeder of claim 12, wherein the second surface comprises a roller mounted on a side of the cam.

15. The part feeder of claim 11, wherein the tape positioning member comprises a manual lever.

16. The part feeder of claim 11, wherein the tape transfer unit comprises a first sprocket wheel that engages and moves the component supply tape, a second sprocket wheel coupled to the first sprocket wheel, and a rotating latch configured to rotate the second sprocket wheel by contacting respective teeth of the second sprocket wheel.

17. A method of feeding a carrier tape, comprising:

providing a tape feeder including a cam, a tape feeding member, a shutter, and a tape setting member;

rotating the cam to simultaneously drive the tape feeding member and the shutter; and operating the tape setting member to drive the tape feeding member, wherein operating the tape setting member does not drive the shutter.

18. The method of claim 17, wherein operating the tape setting member comprises a manual operation.

* * * * *